US005823836A

United States Patent [19]

Anderson

[11] Patent Number: 5,823,836

[45] Date of Patent: Oct. 20, 1998

[54] BOAT MOTOR FLUSHING AND LUBRICATING ACCESSORY

[76] Inventor: Kenneth J. Anderson, 4190 NW. 79th Ave., Suite 2C, Miami, Fla. 33166

[21] Appl. No.: 862,005

[22] Filed: May 22, 1997

[51] Int. Cl.[6] ..... B63H 21/10

[52] U.S. Cl. ..... 440/88; 137/888; 440/113

[58] Field of Search ..... 440/88, 900, 113; 137/888; 239/310; 134/169 A, 168 R, 169 R

[56] References Cited

U.S. PATENT DOCUMENTS 4,121,948 10/1978 Guhlin ..... 134/167 R

*Primary Examiner*—Ed L. Swinehart

*Attorney, Agent, or Firm*—McHale & Slavin P.A.

[57] ABSTRACT

A flushing system accessory comprises a one-piece connector and a lubricating-fluid vessel. The connector has a threaded first intake port connected to the lubricating-fluid vessel. The connector also includes a threaded second intake port which is connected to a water supply hose. The connector further includes a threaded outlet port sized for connection to a boat motor flushing aid. The one-piece connector has an end carrier chamber which is divided by a partition wall into a first passageway and a second passageway. The intake and outlet ports are in fluid communication with the interior chamber. Lubricating fluid, supplied by the lubricating-fluid vessel, and water, supplied by a water supply hose, enter through a first and second intake port, respectively. They then pass through the connector outlet port and into an attached boat motor flushing aid.

8 Claims, 2 Drawing Sheets

BOAT MOTOR FLUSHING AND LUBRICATING ACCESSORY

FIELD OF THE INVENTION

This invention relates to boat motor servicing and more specifically to an accessory flushing device which selectively supplies lubricating fluids with or without an attendant supply of water.

BACKGROUND OF THE INVENTION

Boat motors are internal combustion engines which generate a great deal of heat during use. The heat is a result of fuel combustion and associated friction produced by moving parts. For this reason, most outboard and inboard/outboard motors have a cooling system for purposes of dissipating heat. Typically the cooling system is based upon a raw water pump for circulation of water through the engine, the raw water coming from a lake, river, or ocean from which the boat is operated on. Engine heat is dissipated into the water and the water discharged from the engine. As a result, the motor temperature is kept within an acceptable range.

To maintain the life of a boat engine, boat engines are typically flushed after use. This is especially important when the engine is used in salt water. Salt water is highly corrosive and can quickly cause internal rusting of the engine. Operation of the boat in fresh water can also cause problems requiring flushing such as when the boat is used in areas of high silt, sand, or vegetation. All such matter can clog an engine leading to overheating. Should the matter be allowed to dry inside the engine, the matter can clog heat exchanges, oil coolers, transmission coolers and the engine jacket, all of which have small orifices. If sand or silt is left to dry inside the engine, starting of the engine may lead to overheating, and the gritty material may irreparably harm the raw water pump and/or circulation pump.

Like the rest of the motor, maintenance of the water pump ensures effective operation and prevents unexpected break downs. Proper maintenance includes inspection of the pump impeller and periodic lubrication of water pump parts. Lubrication will insure that the pump is circulating water efficiently and removing as much heat as possible.

While the water pump and the cooling system maintenance is very important, it can be difficult to perform. For example, motor flushing requires that a continuous supply of fresh water be directed into the lower unit of an outboard or I/O boat motor. One of the most commonly-used flushing devices is a pair of rubber sealing cups which are held in place by a U-shaped bracket. The cups are placed over the intake water ports on the outside of the lower unit. One of the suction cups has a threaded aperture or conduit to which a conventional garden hose may be attached. By placing the suction cup conduit over a boat motor water intake port, water may be directed from the hose, through the conduit, and into the boat motor lower unit. Directing water into the lower unit in this fashion while the motor is running, will flush the motor, removing the above-described unwanted deposits.

Early versions of this sealing cup and bracket device, commonly-referred to as a pair of "earmuffs", was often difficult to position correctly and did not ease lubrication at all. With this type of device, water pump lubrication was performed in a separate operation which often required the use of special tools and the disassembly of the boat motor.

Subsequent flushing devices have attempted to resolve the problems inherent in the original "earmuffs", in an attempt to make boat motor maintenance easier.

Some devices include features which make the original earmuff design easier to position. For example, U.S. Pat. No. 5,423,703 teaches an earmuff flushing device coupled to an extension pole. The pole makes the earmuff sealing cups easier to orient correctly. This device is especially useful when flushing the motor which is out of arms length or otherwise difficult to reach.

Other flushing devices are designed to accommodate motors of different sizes. For example, U.S. Pat. Nos. 4,540,009 and 5,397,256 include adjustable brackets. These brackets allow proper sealing-cup placement on a wide variety of motors.

With the introduction of these devices, boat motor maintenance became marginally easier. However, each of these devices only addressed motor flushing. Devices to facilitate water pump lubrication were still needed.

U.S. Design Pat. No. 368,129 shows an example of a device which might ease water pump lubrication in some instances. The '129 Patent shows a siphon valve used to dispense chemicals during motor flushing. Because of its design, however, this device is useful only in a limited number of situations. The '129 valve is designed specifically to mix chemicals with water that is already traveling into a boat motor. Because this device employs a siphon valve, it will dispense chemicals only when joined to a continuous flow of water. That is, the '129 device is unfortunately designed to dispense chemicals only as part of a fluid mixture. When lubricating a water pump, it is often desirable to introduce lubricating fluids which are not mixed with water. The '129 Patent is not suitable at these times, because chemicals, including lubricating fluids, are dispensed only as part of a mixture. While a mixture of water and lubricating fluids is acceptable at some times, it is not acceptable at other times. As a result, the '129 device is not acceptable for use in all lubricating sessions.

Proper boat motor maintenance includes, among other things, regular flushing with fresh water and routine water pump lubrication. Many devices exist which attempt to make boat motor maintenance easier. None of these devices provide a flushing accessory which is easy to position and which allows introduction of lubricating fluids, both full strength (without water) and diluted (as part of a mixture).

Accordingly, what is needed in this field is a device that eases motor flushing and lubricating. The device should be usable with boat motors of various sizes, and be capable of supplying lubricating fluids not mixed with water, lubricating fluids that are mixed with water, and water only.

SUMMARY OF THE INVENTION

The present invention is an accessory designed to be used during the flushing of boat motors, as part of the motor's maintenance. The device employs a one-piece connector which has two intake ports and one outlet port. The connector is substantially hollow and the interior chamber of the connector is divided by a partition wall into two separate passageways. Lubricating fluid, supplied by a disposable bottle attached to one of the intake ports, flows through the first passageway. Water, provided via a hose connected to a continuous water supply, flows through the second passageway. The exit from the first passageway and the exit from the second passageway form complementary portions of the connector outlet port. The connector outlet port attaches to an intake inlet which passes through one of the sealing cups typically found in an open "earmuff"-type boat motor flushing apparatus.

With the present invention attached to an earmuff-type flushing apparatus, lubricating fluid and water may be fed simultaneously to the lower unit of a boat motor which is being flushed.

Accordingly, it is an object of the present invention to provide a boat motor flushing accessory which allows lubricating of the boat motor raw water pump without special tools or motor disassembly.

It is also an object of the present invention to provide a boat motor flushing accessory which facilitates simultaneous rinsing and lubrication during routine boat motor flushing.

Still another object of the present invention is to provide a boat motor flushing accessory that allows for the lubrication of the water jacket, oil cooler, transmission cooler, or any other area that is exposed to raw water.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENT

Figure 1:
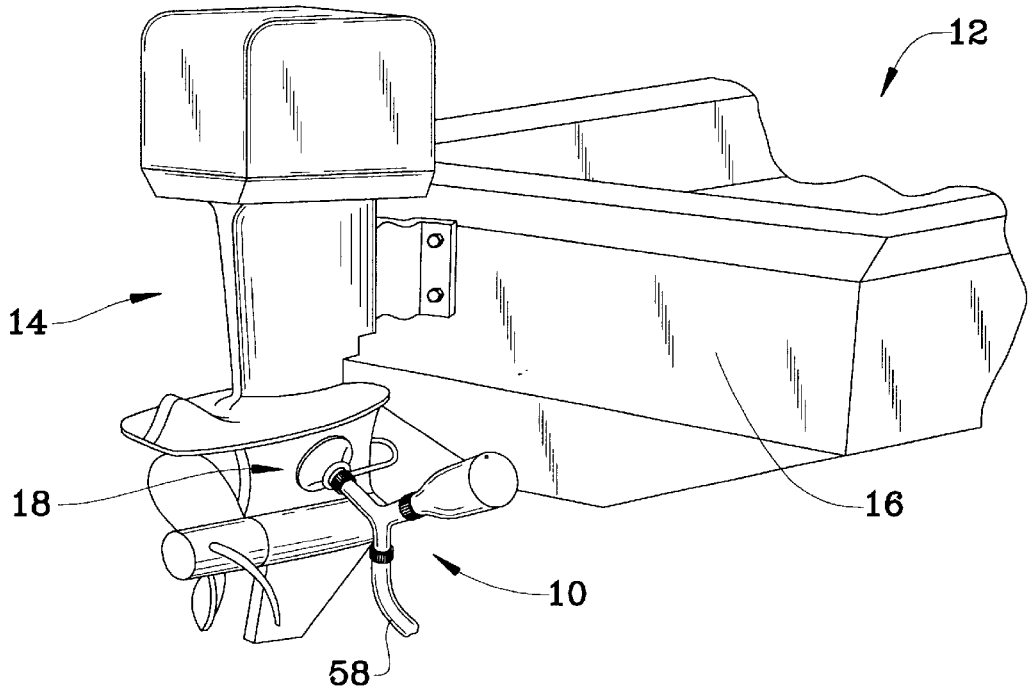
FIG. 1 is a pictorial view of the flushing and lubricating device of the present invention in use on a boat.

With reference to FIG. 1, the boat motor flushing accessory 10 of the present invention is shown connected to a boat 12. More specifically, the flushing accessory 10 is attached to a motor 14 extending from the rear or stern 16 of the boat 12.

Figure 2:
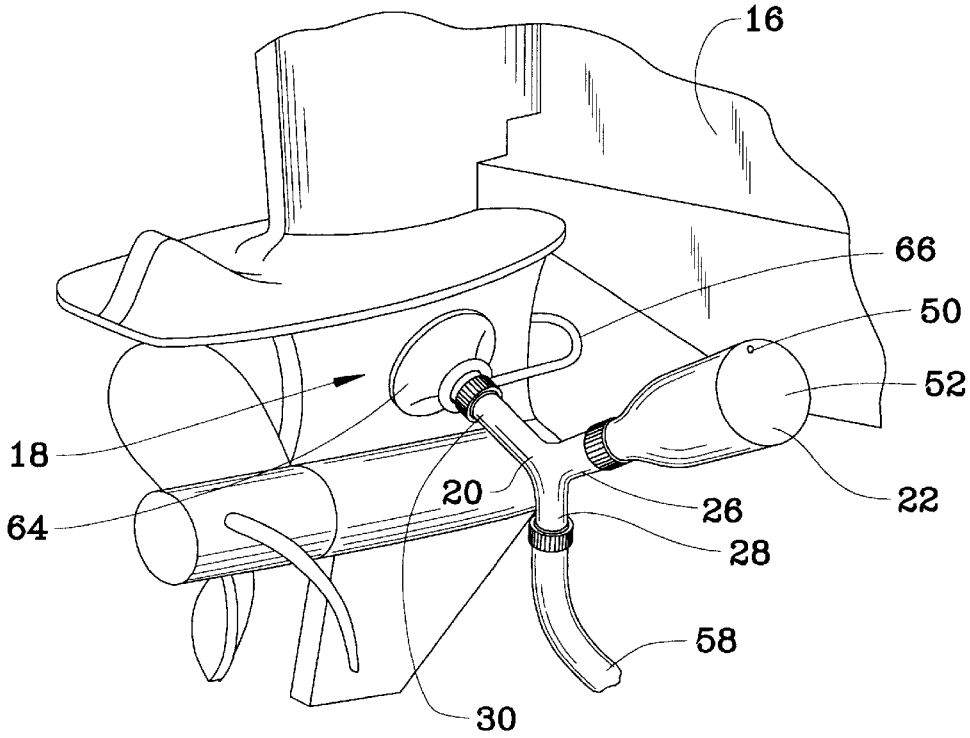
FIG. 2 is a close-up view of the flushing and lubricating device of the present invention attached to the lower unit of a boat motor.

FIG. 2 shows an enlarged view of the flushing accessory 10 attached to a lower unit 18 of the motor 14. The flushing accessory 10 is comprised of several pieces. The accessory 10 includes a substantially-hollow, one-piece connector 20 and a disposable bottle 22. The one-piece connector 20 has an interior chamber 24 that is bound by a first intake port 26, a second intake port 28, and a single outlet port 30.

Figure 3:
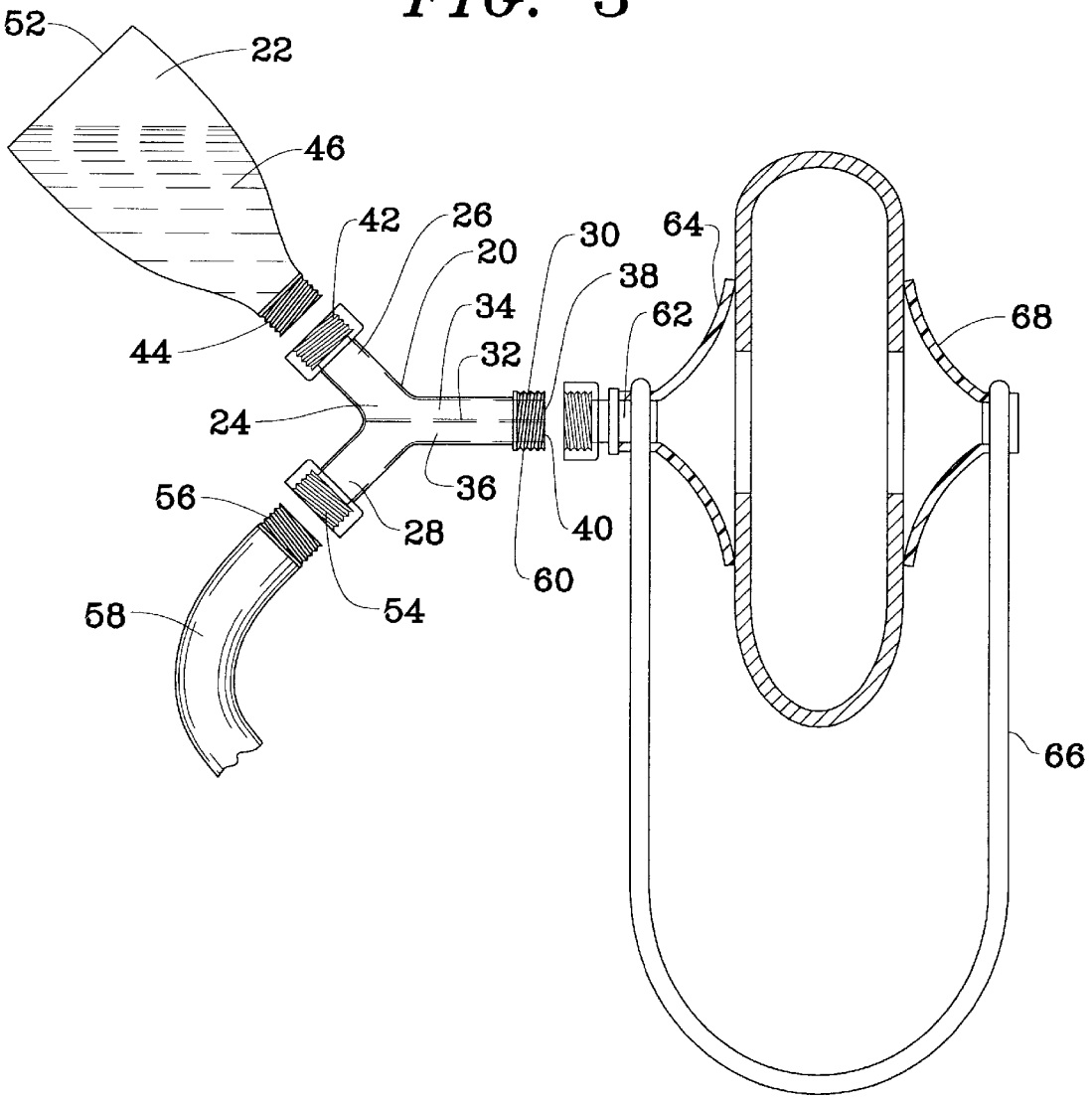
FIG. 3 is an exploded view of the flushing and lubricating device of the present invention attached to a sealing cup of a conventional boat motor flushing aid.

As shown in FIG. 3, the interior chamber 24 is not contiguous; a partition wall 32 divides the chamber into a first passageway 34 and a second passageway 36. The partition wall 32 completely separates the first and second passageways 34, 36. The wall 32 extends into the outlet port 30 and divides the outlet port into a first exit 38 and a second exit 40.

Figure 4:
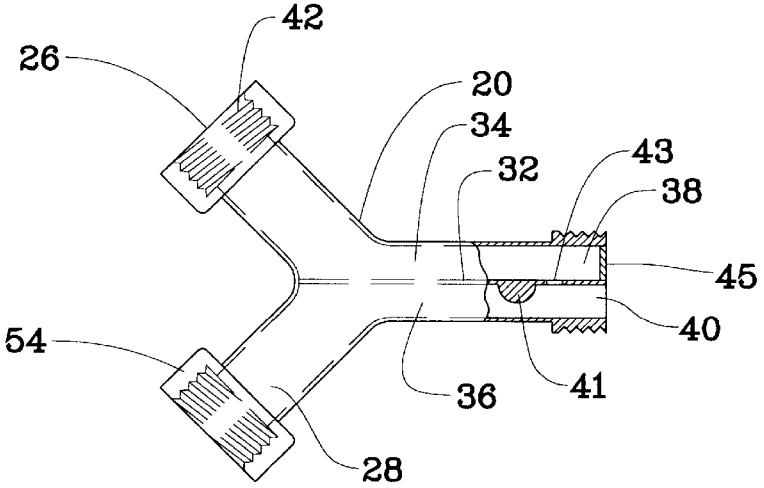
FIG. 4 is an exploded view of an alternate embodiment of the flushing and lubricating device of the present invention.

In an alternate embodiment, shown in FIG. 4, the partition wall 32 includes a restriction member 41 and a transfer orifice 43. The restriction member 41 is essentially a beam having a semi-circular cross section. The curved surface of the restriction member extends away from the partition wall 32, jutting into the second passageway 36. The major axis of the restriction member 41 lies perpendicular to the major axis of the partition wall 32. Additionally, a deflection wall 45 seals the first exit 38. Together, the restriction member 41, transfer orifice 43, and deflection wall 45, act as an inductor which draws fluid from the first passageway 34 into the second passageway 36. The transfer orifice 43 perforates the partition wall 32 and is located between the restriction member 41 and deflection wall 45.

The first intake port 26 and first exit 38 are both in fluid communication with the first passageway 34. Similarly, the second intake port 28 and second exit 40 are in fluid communication with the second passageway 36.

The first intake port 26 contains threads 42 which are sized to engage a threaded aperture 44 disposed on the disposable bottle 22. The bottle 22 includes a lubricating fluid 46. Olive oil is the preferred lubricating fluid; however, other suitable fluids may be substituted. A vent opening 50 extends, through the wall 52 of the bottle 22 and prevents creation of a vacuum within the bottle, allowing the lubricating fluid 46 to exit the bottle through the threaded aperture 44. As the lubricating fluid 46 leaves the threaded aperture 44, it passes through the first intake port 26 and flows into the first passageway 34.

The second intake port 28 contains threads 54 which are sized to engage a threaded first end 56 of a water supply hose 58. The hose 58 has a threaded second end (not shown) which is coupled to a continuous supply of water (not shown). Although the connector 20 has been described as having two passageways 34, 36, it may be divided into any number of passageways with intake ports added as necessary.

As shown in FIGS. 2 and 3, the outlet port 30 has threads 60 sized to engage a threaded conduit 62 disposed within a flushing system first sealing cup 64.

In use, the first sealing cup 64 placed against a boat motor water inlet (not shown) is located in the motor lower unit 18. The first sealing cup 64 is connected, via a U-shaped bracket 66 to a second sealing cup 68. The first sealing cup 64, second sealing cup 68, and U-shaped bracket 66 cooperate to secure the outlet port 30 against boat motor water inlet. When the outlet port 30 is so positioned, the outlet port 30 is fluidly coupled with the boat motor water inlet. As such, lubricating fluid 46 and/or a continuous supply of water passes through the connector 20 and enters the boat motor lower unit 18. Operating the boat motor water pump (not shown) as the fluid 46 and water are introduced will simultaneously lubricate and flush the boat motor, lengthening the operating life of the motor.

During motor flushing, the unique design of the present invention allows non-diluted lubricating fluid to begin flowing into the lower unit 18 without an attendant flow of water. This advantageously allows the motor 14 to be "pre-lubricated" before the motor is started during a flushing session.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. A flushing system accessory comprising:

a one-piece connector housing having a first intake port, a second intake port, an outlet port, and an interior chamber, said first intake port, said second intake port, and said outlet port being in fluid communication with said interior chamber;

a lubricating-fluid vessel fluidly coupled to said first intake port; and a partition wall that divides said interior chamber into a first passageway and a second passageway, said first passageway having a first exit, and said second passageway having a second exit, said first and second exits forming complementary portions of said outlet port;

whereby said connector simultaneously attaches two sources of fluid to a single intake port on a boat motor flushing device, wherein fluids provided by the fluid sources occupy separated chambers while inside said connector and do not mix until traveling past a terminal end of said outlet port.

2. The flushing system accessory of claim 1, said lubricating-fluid vessel being defined as a disposable bottle having a means for releasing pressure within said vessel, said vessel further including a connection means for coupling said vessel to said first intake port.

3. The flushing system accessory of claim 2, wherein said connection means includes a threaded aperture disposed within said vessel; and threads disposed on said first intake port sized to engage said threaded aperture.

4. The flushing system accessory of claim 1, further including threads disposed on said second intake valve; a hose of predefined length and diameter; said hose having a threaded first end sized to engage said threads on said first intake port, and a second end; and a continuous supply of water fluidly coupled to said second end of said hose.

5. A flushing system accessory comprising:

a one-piece connector housing having a first intake port, a second intake port, an outlet port, and an interior chamber, said first intake port, said second intake port, and said outlet port being in fluid communication with said interior chamber;

a lubricating-fluid vessel fluidly coupled to said first intake port; and a partition wall that divides said interior chamber into a first passageway and a second passageway, said first passageway having a first exit, and said second passageway having a second exit, said first and second exits forming complementary portions of said outlet port, said first exit occupied by a deflection plate;

a restriction member extending from said partition wall into said second passageway, said restriction member having a semi-circular cross section; and a transfer orifice passing through said partition wall, said transfer orifice oriented longitudinally between said restriction wall and said restriction member;

whereby said connector simultaneously attaches two sources of fluid to a single intake port on a boat motor flushing device, wherein said deflection wall, said restriction member, and said transfer orifice act as an inductor to preferably draw fluid from said first passageway into said second passageway.

6. The flushing system accessory of claim 5, said lubricating-fluid vessel being defined as a disposable bottle having a means for releasing pressure within said vessel, said vessel further including a connection means for coupling said vessel to said first intake port.

7. The flushing system accessory of claim 6, wherein said connection means includes a threaded aperture disposed within said vessel; and threads disposed on said first intake port sized to engage said threaded aperture.

8. The flushing system accessory of claim 5, further including threads disposed on said second intake valve; a hose of predefined length and diameter; said hose having a threaded first end sized to engage said threads on said first intake port, and a second end; and a means for providing a continuous supply of water fluidly coupled to said second end of said hose.

* * * * *